US008561441B2

(12) United States Patent
Herrmann et al.

(10) Patent No.: US 8,561,441 B2
(45) Date of Patent: Oct. 22, 2013

(54) LOCKABLE CONTAINER ARRANGEMENT

(75) Inventors: Jonas Herrmann, Eskilstuna (SE); Kjell Eriksson, Eskilstuna (SE); Bjorn Larsson, Billdal (SE); Per Moller, Leksand (SE)

(73) Assignee: SCA Hygiene Products AB, Göteborg (SE)

( * ) Notice: Subject to any disclaimer, the term of this patent is extended or adjusted under 35 U.S.C. 154(b) by 275 days.

(21) Appl. No.: 12/936,213

(22) PCT Filed: Apr. 4, 2008

(86) PCT No.: PCT/SE2008/000246

§ 371 (c)(1),
(2), (4) Date: Oct. 4, 2010

(87) PCT Pub. No.: WO2009/123509

PCT Pub. Date: Oct. 8, 2009

(65) Prior Publication Data

US 2011/0024425 A1 Feb. 3, 2011

(51) Int. Cl.
*B65D 55/14* (2006.01)

(52) U.S. Cl.
USPC ..... 70/162; 70/63; 70/69; 70/84; 70/DIG. 20; 292/108; 292/DIG. 37

(58) Field of Classification Search
USPC ..... 70/63, 69–75, 78–81, 84, 159–162, 70/DIG. 20; 292/108, DIG. 37
See application file for complete search history.

(56) References Cited

U.S. PATENT DOCUMENTS

| | | | |
|---|---|---|---|
| 1,965,939 | A | 7/1934 | Jacobi |
| 2,382,756 | A | 8/1945 | Wagner et al. |
| 2,624,191 | A | 1/1953 | Boden et al. |
| 2,720,773 | A | 10/1955 | Gehrie |
| 3,402,578 | A | 9/1968 | Atkinson |
| 3,500,667 | A | 3/1970 | Jespersen |

(Continued)

FOREIGN PATENT DOCUMENTS

| | | | |
|---|---|---|---|
| CN | 100357560 | C | 12/2007 |
| DE | 10329691 | A1 | 2/2005 |

(Continued)

OTHER PUBLICATIONS

Decision on Grant, dated Mar. 31, 2012, in Application No. 2010145107.

(Continued)

*Primary Examiner* — Suzanne Barrett
(74) *Attorney, Agent, or Firm* — Buchanan Ingersoll & Rooney PC

(57) ABSTRACT

A lockable container arrangement includes an interior and an exterior, the container includes a base part, a cover pivotally attached to the base part for displacement between a closed position in which the cover and the base delimit a substantially enclosed space and an open position, a lock mounted on the container, the lock including a lock catch operable from the exterior of the container, which lock catch engages a receiving portion to lock the container. The container arrangement can be selectively set in a key operated mode where the lock catch is operable by a key, or in a push button operated mode where the lock catch is operable by the application of a force onto the lock by a user.

19 Claims, 8 Drawing Sheets

(56) References Cited

U.S. PATENT DOCUMENTS

| | | | | | |
|---|---|---|---|---|---|
| 3,659,444 | A | | 5/1972 | Wellekens | |
| 3,919,866 | A | * | 11/1975 | Lipschutz | 70/81 |
| 4,073,170 | A | * | 2/1978 | Miyabayashi et al. | 70/256 |
| 4,194,377 | A | | 3/1980 | Maeda | |
| 4,306,431 | A | * | 12/1981 | Craig | 70/79 |
| 4,813,253 | A | * | 3/1989 | Dumas | 70/69 |
| 4,852,372 | A | * | 8/1989 | Ling | 70/312 |
| 5,048,315 | A | | 9/1991 | Rekuc | |
| 5,259,221 | A | | 11/1993 | Whitmore | |
| 5,265,453 | A | | 11/1993 | Konii et al. | |
| 5,308,126 | A | * | 5/1994 | Weger et al. | 292/53 |
| 5,657,652 | A | * | 8/1997 | Martin | 70/85 |
| 6,006,558 | A | * | 12/1999 | Peters | 70/63 |
| 6,098,434 | A | | 8/2000 | Liou | |
| 6,231,091 | B1 | * | 5/2001 | Gleason et al. | 292/34 |
| 6,523,378 | B2 | | 2/2003 | Kuo | |
| 6,575,503 | B1 | * | 6/2003 | Johansson et al. | 292/170 |
| 6,899,362 | B1 | | 5/2005 | Weinerman et al. | |
| 6,964,184 | B1 | | 11/2005 | Gregory | |
| 7,240,523 | B2 | | 7/2007 | Johansson et al. | |
| 7,409,842 | B2 | | 8/2008 | Kuo | |

FOREIGN PATENT DOCUMENTS

| | | | |
|---|---|---|---|
| EP | 0085586 | A1 | 8/1983 |
| GB | 2131865 | A | 6/1984 |
| RU | 44133 | U1 | 2/2005 |
| RU | 60585 | U1 | 1/2007 |
| WO | 92/18733 | A1 | 10/1992 |
| WO | 9218733 | A1 | 10/1992 |

OTHER PUBLICATIONS

International Search Report, dated Nov. 6, 2008, from corresponding PCT application.

Notification Concerning Transmittal of International Preliminary Report on Patentability (Form PCT/IB/326), International Preliminary Report on Patentability (Form PCT/IB/373), Written Opinion of the International Search Authority (Form PCT/ISA/237) mailed in corresponding International Patent Application No. PCT/SE2009/050348, Oct. 14, 2010, The International Bureau of WIPO,Geneva, CH.

PCT International Search Report dated Jun. 30, 2009 issued in the corresponding PCT Application No. PCT/SE2009/050348.

Co-pending U.S. Appl. No. 12/936,059 to Eriksson, filed Feb. 1, 2011.

Chinese First Notification of Office Action dated Oct. 29, 2012 issued in the corresponding Chinese Patent Application No. 200810095347.3 and English language translation.

Chinese Official Action dated Oct. 31, 2012 issued in the corresponding Chinese Patent Application No. 200880129619.5 and English language translation.

Non-Final Office Action dated Apr. 3, 2013 issued in co-pending U.S. Appl. No. 12/936,059 to Eriksson, filed on Feb. 1, 2011. (37C.F.R. 1.97(e)(2) certification applies to this reference).

Mexican Office Action dated Apr. 15, 2013 issued in the corresponding Mexican Patent Application No. 2010/010863. (37C.F.R. 1.97(e)(1) certification applies to this reference).

Notification of Second Office Action dated Jul. 22, 2013 issued in corresponding Chinese Patent Application No. 200880129619.5 and English language translation (11 pages).

* cited by examiner

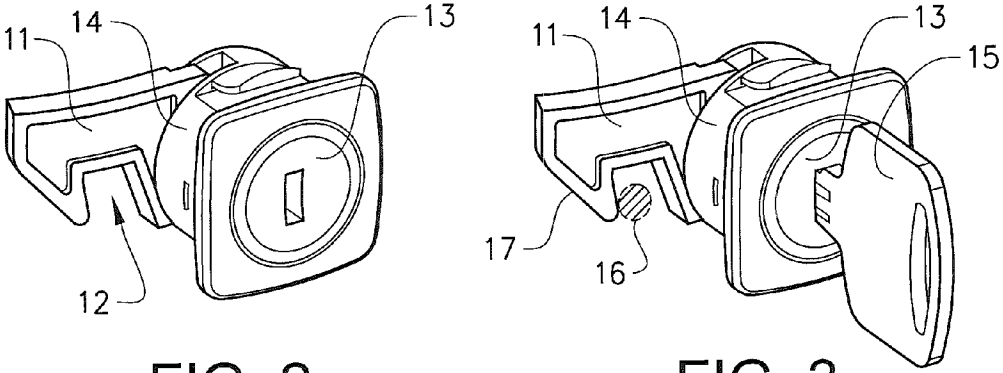
FIG. 2
FIG. 3
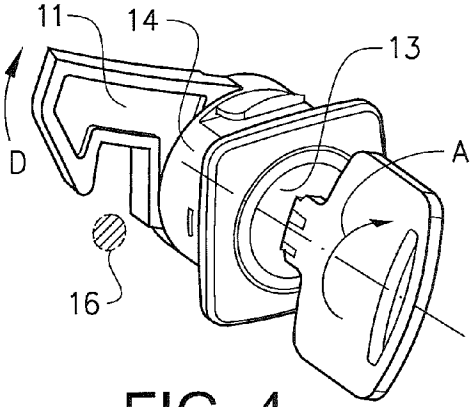
FIG. 4
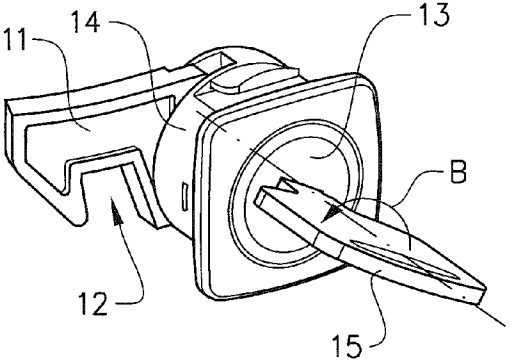
FIG. 5
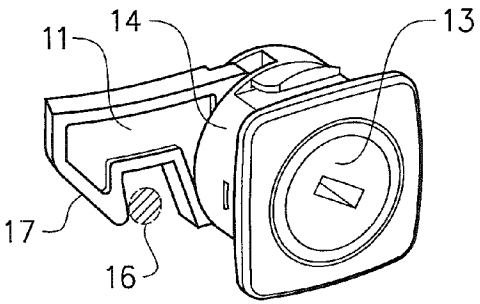
FIG. 6
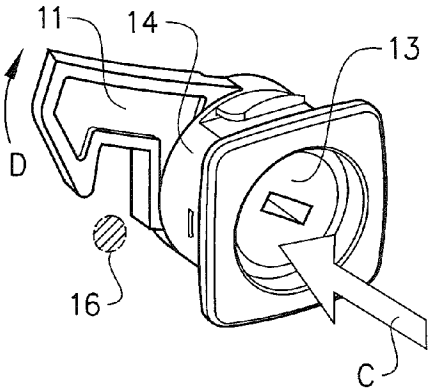
FIG. 7

LOCKABLE CONTAINER ARRANGEMENT

TECHNICAL FIELD

The present invention concerns a lockable container arrangement in the form of a base part and a cover pivotally attached to the base part such as to be lockable in a closed position relative thereto, whereby a lock of a lock and key arrangement presents a locking catch to maintain the cover in a closed position and which arrangement can be selectively set in a key operated mode or in a push button operated mode.

BACKGROUND ART

Containers such as dispensers for consumable materials in kitchens, toilets or similar are often required to be locked, in particular when located in more public places. It has become necessary to be able to lock the container to prevent the entire contents of the container from being removed by an unauthorized person, while at the same time allowing successive feeding out of for example contained paper, washing substances or the like. Re-filling of the container is then carried out by authorized persons having access to a key for unlocking the container or dispenser. However, for containers intended for smaller workplaces, for private use or similar it may be an inconvenience to keep track of the respective key and to unlock the container for refilling of the consumable material. As the task of refilling may be carried out by more than one person it is often not desirable to lock the container.

A natural placement of the key is inside the container, but placing the key somewhere in the container without a suitable release means would mean that the key becomes locked inside, in the case that the lock is of the self-locking type with spring-return to the locking position upon closing of the container, which in turn would lead to obvious difficulties.

WO 92/018733 describes one lock arrangement that addresses this problem. The locking ability is achieved by means of a lock, the main part of which is arranged in the cover and presents a locking cylinder with a slot, in which is arranged a key for locking and unlocking. The lock has a lock catch rotatable by means of the key, said lock catch being adjustable between a locking position and a free position. As part of the lock there is arranged a locking edge in the console which, in the shown example, is formed by an opening edge portion of an opening arranged in the console. According to this document, the container presents a holder for the key arranged internally, which holder is positioned so that, with the key placed in the holder, the lock is prevented from assuming the locking position. In this free position, the container is maintained closed by a snap-lock that may be opened by hand.

A problem with this solution is that the container is not properly locked when it is desired to allow the container to be opened by hand, without using a key. A further problem is that the above solution requires a separate snap-lock to be provided in order to maintain the container closed when the key is not used, adding to the complexity of the container as well as the cost for materials and assembly. The invention aims to provide an improved lockable container arrangement to solve the above problems and to facilitate handling of the container.

DISCLOSURE OF INVENTION

The above problems have been solved by a lockable container arrangement according to the appended claims.

The invention relates to lockable container arrangements, in particular dispensers for consumable materials in kitchens, toilets or similar. Dispensers of this type may be intended for rolls or stacks of paper or other wiping materials, or for washing substances such as liquid hand cream, soap or other detergents.

In the subsequent text, terms such as front, rear, inner and outer are defined in relation to the visible outer surface of the container in which the lock is mounted.

According to a first embodiment, the lockable container arrangement comprises an interior and an exterior, said container comprising a base part, a cover pivotally attached to the base part for displacement between a closed position in which the cover and the base delimit a substantially enclosed space and an open position. The base part is preferably arranged to contain said consumable materials. The arrangement further comprises a lock mounted on said container, said lock comprising a lock catch operable from the exterior of the container, which lock catch engages a receiving portion to lock the container. The lock comprises a lock cylinder arranged in direct or indirect contact with and cooperating with the lock catch. The lock cylinder is arranged in a housing and is locked against rotation relative to the container unless an appropriate key has been inserted into the lock cylinder. The housing is mounted in a recess in the dispenser and may be fixed in position and against rotation by any suitable means. The container arrangement can be selectively set in a key operated mode, wherein the lock catch is operable by a key, or in a push button operated mode, wherein the lock catch is operable by the application of a force onto a portion of the lock by a user. In the latter case, the lock catch is movable by axial displacement of the lock cylinder caused by the user pushing the lock cylinder.

In accordance with the invention, the key is rotatable in a first direction, which rotation sets the container arrangement in the key operated mode. The lock catch is operable by the rotation of the key in the first direction. As long as the key is used, rotation of the key in the said first direction will either unlock the cover or set the container arrangement in the key operated mode before unlocking the cover. In the key operated mode, the lock may be prevented from being opened when pushed or be disconnected from the mechanism controlling the lock catch. The lock catch may comprise a radially extending portion having a general J-shape, L-shape or similar, wherein a locking recess in the lock catch may be hooked over or around a receiving portion. The receiving portion may comprise a striker or an edge around which the locking recess is held in position to retain the cover in its closed position. Usually, the said striker or edge is located in a plane at right angles to a plane through the main body of the radially extending portion of the lock catch, wherein the part of the striker or edge facing the locking recess is arranged parallel to the axis of rotation of the lock catch.

When the lockable container arrangement is in the key operated mode, the lock cylinder is arranged in an initial position, from which it is rotatable into a first position together with the lock catch once a key is inserted. In this mode, the lock cylinder is preferably, but not necessarily prevented from axial displacement.

According to a first alternative example of the key operated mode, the lock cylinder passes through a corresponding opening in the lock catch. The lock catch is arranged rotatable about the central axis of the lock cylinder, but is fixed against axial displacement relative to the housing. In order to cause a rotation of the lock catch, the lock cylinder is provided with a first peripheral rib or a similar projection, arranged in a substantially axial direction along the outer surface of the substantially cylindrical lock cylinder. This first peripheral rib is arranged to cooperate with at least one of a pair of opposing surfaces in a radially extending first recess in the opening in the lock catch.

The first recess in the lock catch may be a radial cut-out second section extending over a predetermined first angle, wherein the first peripheral rib on the lock cylinder is arranged in predetermined positions between the facing end surfaces of the first recess. In this example, the end surfaces of the first recess are located in axial planes through the lock cylinder, which planes are separated by said predetermined first angle. When in the key operated mode, the first peripheral rib on the lock cylinder is located in contact with a first end surface of the first recess. When an appropriate key is inserted into the lock cylinder, the lock cylinder may be rotated relative to its housing. By rotating the key in the first direction, the first peripheral rib located in contact with the first end surface will apply a force onto said first end surface and thus to the lock catch. As the key is rotated, the lock catch is forced to rotate with the lock cylinder and will be released from the receiving portion to allow the cover to be opened. The lock catch is spring loaded towards its locking position and will return the lock catch and the lock cylinder to the initial position as soon as the key is released.

In order to close the cover, the user simply pushes the cover towards its closed position. A bevelled front surface on the lock catch will first come into contact with the receiving portion. An additional force applied to the front wall of the cover will cause the bevelled surface to displace the lock catch relative to the receiving portion. During this displacement, the first surface of the first recess is displaced away from the first rib on the lock cylinder towards an intermediate position between the opposing surfaces. In this way the lock catch can be rotated separate from the lock cylinder. The lock catch will be rotated against the force of the spring load and allow a front portion of the lock catch to move past the receiving portion so that the locking recess in the lock catch may be hooked over or around a receiving portion. The lock catch may then snap back under the force of the spring load into engagement with the receiving portion to lock the container.

The key is further rotatable in a second direction, opposite to the first direction, which rotation sets the container arrangement in the push button operated mode. The key may then be removed and the lock can be opened by pushing the lock cylinder.

In order to set the lock in the push-button operated mode the key is rotated in the second direction, from the initial position in the key operated mode into a distinct second position. To achieve this, the lock cylinder and the housing may be provided with facing cooperating surfaces each located in a radial plane relative to the axis of the lock cylinder. The radial surfaces are arranged to prevent axial displacement of the lock cylinder while the lock is in the key operated mode. For instance, a second rib or a similar projection on the outer surface of the lock cylinder may be arranged to cooperate with a radial recess or annular surface in the housing. When in the key operated mode, an end surface of the second rib is prevented from axial displacement by the facing radial recess.

When the lockable container arrangement is switched from the key operated mode to the push-button mode, the key is rotated in the second direction, opposite to the first direction. By rotating the lock cylinder the second rib will be displaced from a first end position into a second end position in said radial recess in the housing. In the second end position the second rib is indexed relative to a section of the radial recess extending a predetermined axial distance into the housing. The lock cylinder may then be pushed into the housing against the force of a return spring means, allowing the lock cylinder to be axially displaced a predetermined distance relative into the housing. This distance may be determined by the axial extension of the radial recess in the housing. The rotation of the lock cylinder in the second direction also causes the first peripheral rib to be displaced in the first recess. The first peripheral rib will be displaced from its first position in contact with the first end surface to a second position intermediate the first surface and its opposing second end surface.

When the lockable container arrangement is in the push-button operated mode, the lock cylinder is arranged axially slidable in an aperture in the lock catch. In this way, the lock cylinder itself may be used as a push button for unlocking the container. A resilient means, such as a return spring, may be provided between the housing and the lock cylinder. Axial displacement of the lock cylinder from a first position to a second position will compress the resilient means, which means will return the lock cylinder to its first position upon release of the lock cylinder.

According to a first alternative example of the push button operated mode, the lock cylinder is provided with an oblique surface arranged to cooperate with a corresponding surface in a radially extending second recess in the opening in the lock catch. The oblique surface may be arranged on a radial projection, such as a peripheral rib or similar, extending in the longitudinal direction of the lock cylinder. The said surface may be arranged at an angle to the direction of an imaginary generatrix along the outer surface of the substantially cylindrical lock cylinder. The oblique surface on the third rib may be a helical surface arranged at an angle preferably less than 45° relative to the direction of an imaginary generatrix of the lock cylinder. The angle is selected depending on a number of factors, such as the available distance that the lock cylinder may be pushed, the maximum desired force required by the user, the strength of the material used in the various components, etc. The second recess in the lock catch may be a radial cut-out first section extending over a predetermined first angle, wherein the oblique surface on the lock cylinder is arranged facing an end surface of that part of the second recess located adjacent the projection. In this example, the end surfaces of the second recess are located in axial planes through the lock cylinder, which planes are separated by said predetermined first angle. As the oblique surface on the projection is arranged facing the end surface of the second recess, the lock catch is forced to rotate as the lock cylinder and its oblique surface is forced into contact with said end surface of the second recess.

According to a second alternative example of the push button operated mode, the lock cylinder is provided with a radially extending projection arranged to cooperate with an oblique surface in a second recess in the lock catch. The radially extending projection may be a single projection, such as a cylindrical stud, or a peripheral rib arranged in the axial direction of the outer surface of the lock cylinder. The second recess in the lock catch may be a radial cut-out first section extending over a predetermined first angle, wherein the oblique surface is arranged in the end surface of that part of the second recess located adjacent the projection. In this way, the oblique surface is arranged facing the projection and the lock catch is forced to rotate as the lock cylinder and its projection is forced into contact with the oblique surface of the second recess.

According to a third alternative example of the push button operated mode, the lock cylinder is provided with an oblique surface arranged to cooperate with a corresponding oblique surface in a radially extending second recess in the lock catch. This example is a combination of the first and second examples described above and will operate in substantially the same way. Consequently, the oblique surface on a radially extending projection on the lock cylinder is arranged facing an oblique end surface of the second recess. The lock catch is forced to rotate as the lock cylinder and its oblique surface is forced into contact with said oblique end surface of the second recess. In the examples described in this text, the term "oblique surface" may define both straight and helical surfaces. The gradient or pitch of such a surface is determined by the desired angle of rotation of the lock catch in relation to the maximum axial displacement of the lock cylinder.

In order to close the cover, the user simply pushes the cover towards its closed position. As described above, a bevelled front surface on the lock catch will first come into contact with the receiving portion. An additional force applied to the front wall of the cover will cause the bevelled surface to displace the lock catch relative to the receiving portion. Displacement of the lock catch will also cause a relative displacement between the opposing surfaces of the first recess and the stationary first rib on the lock cylinder. Towards the end of the displacement the first rib will be located adjacent the second surface, away from the intermediate position between the said opposing surfaces. The lock catch will be rotated against the force of the spring load and allow a front portion of the lock catch to move past the receiving portion so that the locking recess in the lock catch may be hooked over or around a receiving portion. The lock catch may then snap back under the force of the spring load into engagement with the receiving portion to lock the container.

According to a second embodiment, the lock cylinder is mounted in a cylindrical body in which the lock cylinder is fixed against axial displacement but selectively rotatable by means of a key. The assembled lock cylinder and cylindrical body forms an actuating means that is mounted axially displaceable against a spring means in a housing. The lock cylinder may be selectively rotated relative the cylindrical body to assume a key operated mode and a push-button operated mode. The cylindrical body is provided with at least one projection on its outer cylindrical surface, which projection may cooperate with a corresponding axial groove or slot through the outer cylindrical wall of the housing. The housing comprises an outer portion that may be attached so as to be fixed and non-rotatable in an opening in the container, where it is accessible to a user, and an inner portion arranged to cooperate with a lock catch. The inner portion of the housing passes through a corresponding opening in the lock catch. The lock catch comprises a cylindrical portion and is arranged rotatable about the central axis of the lock cylinder, but is fixed against axial displacement relative to the inner portion of the housing. The cylindrical portion of the lock catch is provided with at least one substantially angled or helical slot in or through its outer wall. An initial portion of the slot, facing the outer portion of the housing, may be arranged at a first angle relative to a generatrix on the cylindrical portion of the lock catch. The inner, main portion of the slot may be arranged at a second angle relative to said generatrix. For instance, the initial portion of the slot may be arranged at an angle in the range 0° to 20°, while the remaining portion may be arranged at an angle up to 45°. The length of the initial portion of the slot need only be sufficient to accommodate the at least one projection on the cylindrical body.

In the key operated mode the lock cylinder may be rotated relative to the cylindrical body so that a cam on the outer surface of the lock cylinder is indexed relative to a radially extending surface or ledge in the inner opening of the cylindrical portion of the lock catch. In this position the cam on the lock cylinder may contact the radially extending surface in the cylindrical portion of the lock catch. This prevents axial displacement of the actuating means and the container is locked. When a key is inserted, the at least one projection may be displaced into cooperating contact with the initial portion of the slot. Rotation of the key applies a force on the at least one projection which force is transmitted to the initial portion of the slot and causes rotation of the lock catch out of contact with the receiving portion.

The lock may be set in the push button operated mode by rotating the key and the lock cylinder in the opposite direction to that used for key operation of the lock. In this position the cam on the lock cylinder may no longer contact the radially extending surface in the cylindrical portion of the lock catch. In the push-button operated mode the at least one projection cooperates with the axial slot in through the outer cylindrical wall of the housing and with the main portion of the slot in the lock catch. Axial displacement of the actuating means in the axial slot of the housing forces the at least one projection into contact with the angled main slot and causes the cylindrical portion of the lock catch to rotate. In this way the lock catch may be rotated out of contact with the receiving means when the lock cylinder and the cylindrical body are pushed into the housing by a user. The length of the main portion is dependent on the angle or pitch of the slot and the required angle through which the lock catch must be rotated to release the receiving portion.

In order to close the cover, the user simply pushes the cover towards its closed position. As described above, a bevelled front surface on the lock catch will first come into contact with the receiving portion. An additional force applied to the front wall of the cover will cause the bevelled surface to displace the lock catch relative to the receiving portion. When the lock catch is rotated it will force the said at least one projection into the main portion of the slot, during simultaneous axial displacement of the lock cylinder and the cylindrical body against the force of the spring means. The lock catch will be rotated against the force of the spring means and allow a front portion of the lock catch to move past the receiving portion so that the locking recess in the lock catch may be hooked over or around a receiving portion. The lock catch may then snap back under the force of the spring load into engagement with the receiving portion to lock the container. At the same time the lock cylinder and the cylindrical body will return to their initial position.

According to a third embodiment, the lock cylinder is mounted axially displaceable in a housing. The housing comprises an outer portion that may be attached so as to be fixed and non-rotatable in an opening in the container, where it is accessible to a user. The housing further comprises an inner portion attached to the outer portion and arranged in contact with a lock catch. The lock cylinder is mounted axially displaceable inside the inner portion of the housing and passes through a corresponding opening in the outer portion of the housing. The front surface of the lock cylinder may be arranged substantially flush with the front surface of the outer portion of the housing. A first spring means may be located between an inner annular end surface of the inner portion of the housing and a facing annular surface on the lock cylinder, in order to maintain the lock cylinder in an initial position relative to the front surface of the outer portion of the housing. The inner end of the lock cylinder may be inserted through the inner portion of the housing and into an opening in the lock catch at the inner end of said housing. The lock catch is attached to the end of the lock cylinder so that it is rotatable and fixed against axial displacement relative to the lock catch.

A second spring means may be provided to maintain the lock catch in a predetermined, spring loaded position relative to the inner portion of the housing. The lock cylinder and the lock catch may be spring loaded by separate or a combined spring means. The section of the lock cylinder passing through the lock catch is provided with at least one radially extending projection that is arranged to cooperate with a corresponding recess in the lock catch. The at least one projection may be rotated between opposing end surfaces in the recess, which end surfaces define a first and a second position as the lock cylinder is selectively rotated by a key during mode selection.

In the key operated mode the lock cylinder may be rotated relative to the lock catch so that the at least one radial projection on the outer surface of the lock cylinder is moved into contact with a first end surface in the recess in the lock catch. In this position, a cam on the outer surface of the lock cylinder has been rotated into a position where an end surface of the cam is in contact with a cooperating surface in a first recess in the inner wall of the housing. In this position the cam is arranged to prevent the lock cylinder from axial displacement in the inner portion of the housing. Rotation of the key will cause the radial projection on the lock cylinder to be forced against the first end surface of the recess and rotate the lock catch. When rotated against the spring load a locking recess in the lock catch will be moved out of contact with a receiving means and release the cover of the container. The lock catch will return to its initial position when the key is released.

The lock may be set in the push button operated mode by rotating the key and the lock cylinder in the opposite direction to that used for key operation. The at least one radial projection on the outer surface of the lock cylinder is moved into contact with an opposite second end surface in the recess in the lock catch. In this position, the cam on the outer surface of the lock cylinder has been rotated into a position where an end surface of the cam is located in a second recess in the inner wall of the housing. In this position the cam is arranged to allow the lock cylinder to be axially displaced a predetermined distance in the inner portion of the housing. The distance is determined by the axial extent of the second recess.

The lock cylinder may then be displaced into the inner portion of the housing against the force of the first spring means. As the lock cylinder and the lock catch are fixed to each other, axial displacement of the lock cylinder will also cause an axial displacement of the lock catch and move the locking recess out of contact with the receiving means In order to close the cover, the user simply pushes the cover towards its closed position. As described above, a bevelled front surface on the lock catch will first come into contact with the receiving portion. An additional force applied to the front wall of the cover will cause the bevelled surface to displace the lock catch relative to the receiving portion. The lock catch will be rotated about the central axis of the lock cylinder against the spring load of the second spring until the locking recess in the lock catch may snap over the receiving means and hold the cover closed.

According to a fourth embodiment, the lock catch may be arranged to be pivoted out of engagement with the receiving portion under simultaneous axial displacement of the lock cylinder. In order to achieve this, the lock catch is attached to or adjacent a front portion of a housing containing the lock cylinder by means of a pivot joint. The pivot joint may be attached to one side of the housing with its pivot axis at right angles to the longitudinal axis of the lock cylinder. In the push-button operated mode a key is used to set the lock cylinder in a first position. In this position the lock catch may be displaced or pivoted by the lock cylinder as it is pushed inwards by the user. The receiving portion around which the lock catch is releasably attached may extend a predetermined distance into the container from an internal wall. The distance that the receiving portion extends past the lock catch is less than the distance that the lock catch may be displaced or pivoted by lock cylinder. Hence, when the lock cylinder has been pushed into its end position by the user, the recess in the lock catch has been moved out of contact with the receiving portion and may be displaced past said receiving portion to open the cover.

In the key operated mode, the key is used to rotate the lock cylinder into a second position. If the key is turned past this second position, a projection on the outer surface of the lock cylinder is arranged to cooperate with an angled or helical groove in the inner wall of the housing. Rotation of the key will cause a simultaneous axial displacement of the lock cylinder to pivot the lock catch out of contact with the retaining means. The lock cylinder may be provided with a return spring, such as a coil spring between the inner end of the housing and an annular surface on the lock cylinder. When the key is released, the spring means will return the lock cylinder to its initial position.

In order to close the cover, the user simply pushes the cover towards its closed position. As described above, a bevelled front surface on the lock catch will first come into contact with the receiving portion. The lock catch will be rotated against the force of the spring load and allow a front portion of the lock catch to move past the receiving portion so that the locking recess in the lock catch may be hooked over or around a receiving portion. The lock catch may then snap back under the force of the spring load into engagement with the receiving portion to lock the container.

An advantage with the above solution is that a single combined lock may be used both in a key operated mode and in a manual push-button operated mode. In this way the solution requires fewer components and facilitates assembly of the container, which in turn reduces costs.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

FIG. 2 shows a lock according to one embodiment of the invention, where the lock is set in a key operated mode;

FIG. 3 shows the lock of FIG. 2 in an initial position;

FIG. 4 shows the lock of FIG. 2 rotated into a first position with the lock actuated into its open position;

FIG. 5 shows the lock of FIG. 2 rotated into a second position;

FIG. 6 shows the lock of FIG. 2 in the second position, where the lock is set in a push-button operated mode;

FIG. 7 shows the lock of FIG. 2 actuated into its open position;

EMBODIMENTS OF THE INVENTION

Figure 1:
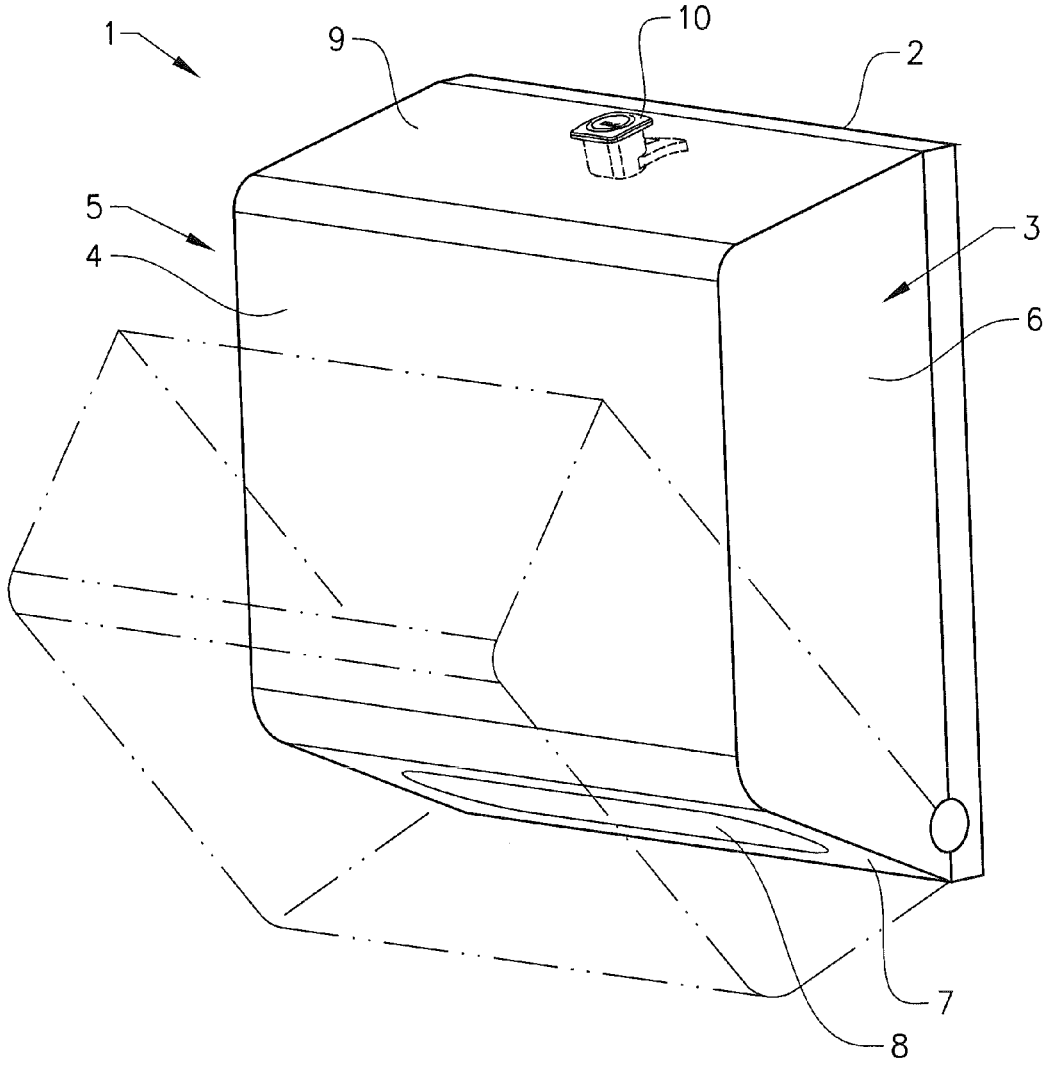
FIG. 1 shows a schematic illustration of a lockable container arrangement according to one embodiment of the invention.

FIG. 1 shows a schematic illustration of a lockable container arrangement according to one embodiment of the invention. The container arrangement in FIG. 1 shows a dispenser for consumable materials in kitchens, toilets or similar. Dispensers of this type can be used for rolls or stacks of paper such as hand towels or other wiping materials. Although any suitable type of lock cylinder may be used for a lock used in the invention, the type described in connection with the figures will be a lock cylinder using at least two spring loaded, transverse lock tumblers.

The lockable dispenser 1 comprises a base part 2, a cover 3 pivotally attached to the base part 2 for displacement between a closed position in which the cover 3 and the base delimit a substantially enclosed space and an open position (indicated in dashed lines). The cover 3 comprises a front wall 4, two side walls 5, 6, a lower wall 7 with a dispensing opening 8 and an upper wall 9. The base part 2 is arranged to contain the said consumable materials, in this case a stack of paper towels. The dispenser 1 further comprises a lock 10 mounted in the upper wall 9 in said dispenser 1. The lock 10 comprises a lock catch 11 operable from the exterior of the dispenser 1, which lock catch 11 engages a receiving portion to lock the dispenser 1. The receiving portion (not shown) can comprise a striker in the form of a bar or an edge in the upper part of the base part 2, around which a recess 12 in the lock catch 11 can be snapped to hold the cover 3 in its closed position.

The dispenser can be selectively set in a key operated mode, wherein the lock catch is operable by a key, or in a push button operated mode, wherein the lock catch is operable by the application of a force onto the lock by a user. These modes will be described in further detail below.

FIG. 2 shows a lock according to one embodiment of the invention. The lock 10 comprises a lock cylinder 13 rotatable in a housing 14 by means of a key or displaceable into the housing by application of a force at the outer end of the lock cylinder 10. The lock cylinder can be arranged in direct or indirect contact with and cooperating with the lock catch. The lock cylinder is arranged to be locked against rotation relative to the housing unless an appropriate key has been inserted into the lock cylinder. The lock catch 11 is preferably arranged rotatable in a plane at right angles to the axis of the lock cylinder 13. Also, the lock catch is arranged to be spring loaded into engagement with the receiving portion, or striker to lock the container.

FIG. 3 shows the lock of FIG. 2 in an initial position with a key 15 inserted into the lock cylinder. In this position the recess 12 in the lock catch 11 engages a striker 16 (indicated having a circular cross-section) in the base part. The key 15 is rotatable in a first direction A, as shown in FIG. 4, which will cause the lock catch 11 to be rotated in the same direction against the action of a spring (not shown). A rotation of the key over a predetermined angle into a first position will actuate the lock to release the lock catch 11 from the striker 16 and allow the cover to be opened. When released, the spring will return the lock catch 11 and the key 15 to the initial position. In order to lock the cover, the cover and the lock catch 11 is simply pushed against the striker 16. An angled surface 17 at the end of the lock catch 11 facing the striker 16 will contact said striker and cause the lock catch 11 to rotate and subsequently snap onto the striker 16 as the cover 3 is pushed towards its closed position.

As long as the key is used, rotation of the key in the first direction A will either unlock the cover or, if the dispenser is in the push-button operated mode, set the dispenser in the key operated mode before unlocking the cover. In the key operated mode, the lock cylinder can either be prevented from being pushed or be disconnected from the mechanism controlling the lock catch so that pushing the lock cylinder will have no effect.

The key 15 is rotatable in a second direction B, opposite to the first direction A, which rotation sets the dispenser in the push button operated mode. In the push-button operated mode, as shown in FIG. 6, a pushing action on the lock cylinder in a third direction C, as shown in FIG. 7, will actuate the lock to release the lock catch 11 to from the striker 16.

Figure 8:
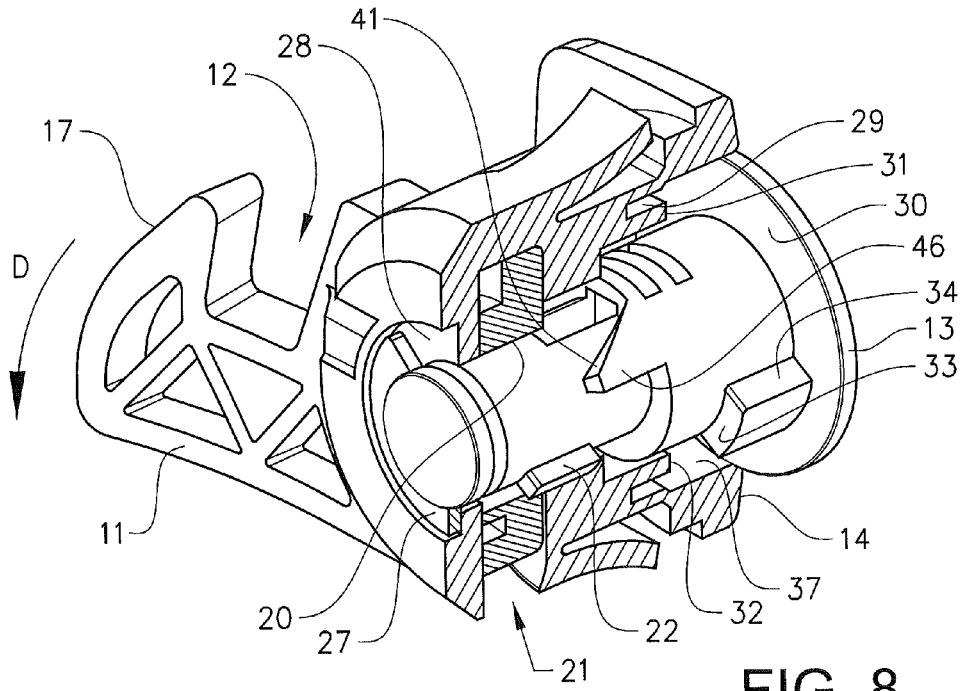
FIG. 8 shows an axial cross-section through the lock of FIG. 2.
Figure 9:
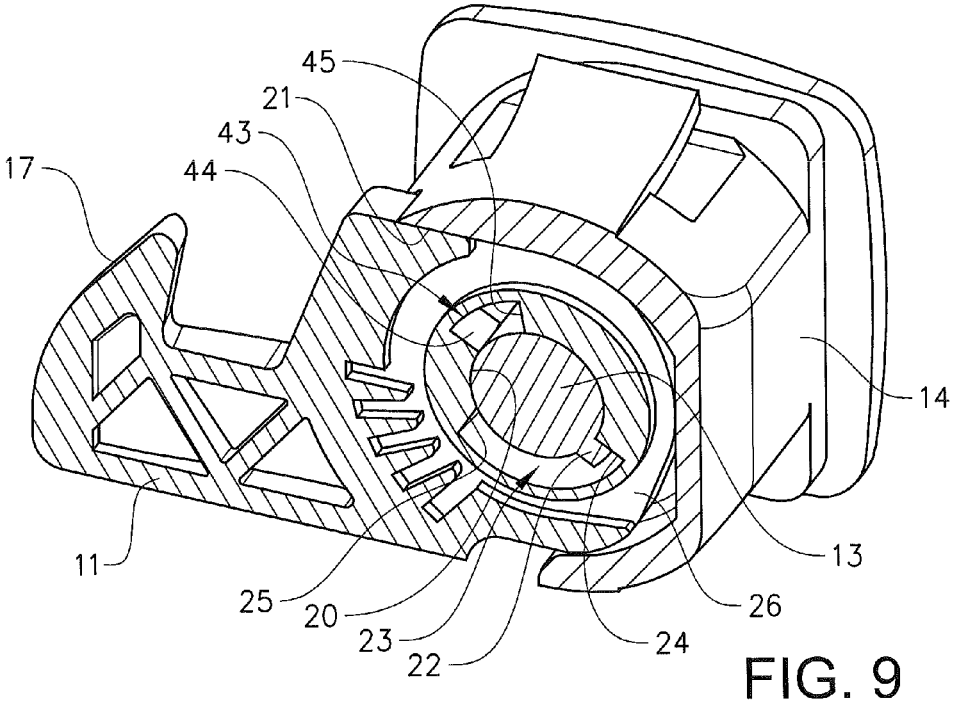
FIG. 9 shows a transverse cross-section through the lock of FIG. 2.

FIG. 8 shows a partial cross-section through the central axis of the lock cylinder of the lock in FIG. 2. FIG. 9 shows a transverse cross-section through the lock catch of the said lock.

According to the example shown in FIG. 8, the lock cylinder 13 passes through a corresponding opening 20 in the lock catch 11. The lock catch 11 is arranged rotatable about the central axis of the lock cylinder 13, in a radial slot 21 in the housing 14. In this way the lock catch 11 is fixed against axial displacement relative to the housing 14. The slot 21 also defines the angle over which the lock catch 11 is allowed to rotate. In order to enable a rotation of the lock catch 11, the lock cylinder 13 is provided with a projection in the form of a first peripheral rib 22. The rib 22 has parallel side surfaces and is arranged in a substantially axial direction along the outer surface of the substantially cylindrical lock cylinder 13. This first peripheral rib is located remote from the outer, or front, surface of the lock. In operation, the rib 22 is arranged to cooperate with one of a pair of opposing surfaces 24, 25 in a radially extending first recess 23 in the opening 20 in the lock catch 11.

The first recess 23 in the lock catch 11 is a radial cut-out second section extending over a predetermined first angle, wherein the first peripheral rib 22 on the lock cylinder 13 is arranged in predetermined positions between the facing end surfaces 24, 25 of the first recess 23. In this example, the end surfaces 24, 25 of the first recess 23 are located in axial planes through the lock cylinder 13, which planes are separated by said predetermined first angle. When in the key operated mode, the first peripheral rib 22 on the lock cylinder 13 is located in contact with a first end surface 24 of the first recess 23. When an appropriate key is inserted into the lock cylinder 13, the lock cylinder 13 may be rotated relative to its housing 14. By rotating the key in the first direction A (see FIG. 4), the first peripheral rib 22 will apply a force onto said first end surface 24 and thus to the lock catch 11. As the key is rotated, the lock catch 11 is forced to rotate with the lock cylinder 13 in the direction, indicated by the arrow D, and will be released from the receiving portion 16 (indicated in FIG. 4) to allow the cover to be opened. The lock catch 11 is spring loaded towards its locking position and will return the lock catch 11 and the lock cylinder 13 to the initial position as soon as the key is released. The spring load is provided by a conventional flat, coiled spring (not shown) located in a groove 26 between the lock catch 11 and the housing 14.

In order to close the cover, the user simply pushes the cover towards its closed position. A bevelled front surface 17 on the lock catch 11 will first come into contact with the receiving portion (not shown). An additional force applied to the front wall of the cover will cause the bevelled surface 17 to displace the lock catch 11 relative to the receiving portion. During this displacement, the first surface 24 of the first recess 23 is displaced away from the first rib 22 on the lock cylinder 13 towards an intermediate position. In the intermediate position the first rib 22 is located approximately halfway between the opposing surfaces 24, 25. In this way the lock catch can be rotated separate from the lock cylinder. The lock catch 11 is rotated against the force of the spring load and allow a front portion of the lock catch 11 to move past the receiving portion so that the locking recess 12 in the lock catch may be hooked over or around a receiving portion. The lock catch 11 may then snap back under the force of the spring load into engagement with the receiving portion to lock the container.

Figure 10:
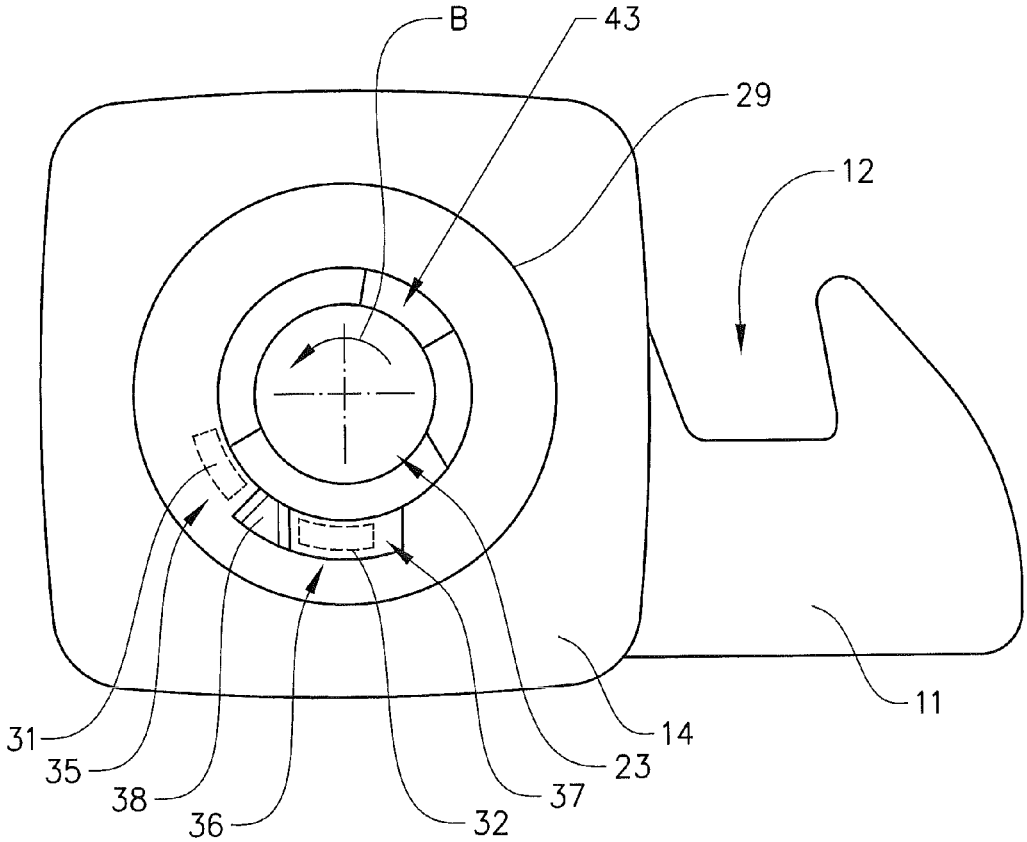
FIG. 10 shows a front view of the housing of the lock of FIG. 2.

The key is further rotatable in a second direction, opposite to the first direction, which rotation sets the dispenser in the push button operated mode. The key may then be removed and the lock can be opened by pushing the lock cylinder 13 into the housing 14. FIG. 10 shows a front view of the housing, with the lock cylinder removed. The lock cylinder 13 is held in place in the housing 14 by a locking washer 27 in a groove at its inner end (see FIG. 8). The locking washer 27 is normally in contact with an end surface 28 of the housing 14. The lock cylinder 13 is spring loaded towards the front of the lock by a coil spring (not shown) located in an annular groove 29 in the housing 14 surrounding the lock cylinder 13. The coil spring acts on an annular radial surface 30 (see FIG. 8) located adjacent the front of the lock cylinder 13.

In order to set the lock in the push-button operated mode the key is rotated in the second direction B (see FIG. 5), from the initial position in the key operated mode into a distinct second position, shown in FIG. 6. To achieve this, the lock cylinder 13 and the housing 14 are provided with facing cooperating radial surfaces 31, 32, 33. A first and a second radial surface 31, 32 are located at different levels in a cylindrical recess in the front portion of the housing. The surfaces 31, 32, 33 are all located in a radial plane relative to the main axis of the lock cylinder 13. Two of the radial surfaces 31, 33 are arranged to prevent axial displacement of the lock cylinder 13 while the lock is in the key operated mode. A second rib 34 on the outer surface of the lock cylinder 13, as shown in FIG. 8, has a radial end surface 33 facing the housing 14. When in the key operated mode, the end surface 33 of the second rib 34 is in contact with a first radial surface 31 in the cylindrical recess in the housing 14. In this way, the lock cylinder is prevented from axial displacement in the key operated mode.

When the lockable dispenser is switched from the key operated mode to the push-button mode, the key is rotated in the second direction B, opposite to the first direction A (see FIGS. 4 and 5). By rotating the lock cylinder 13 the second rib 34 will be displaced from a first end position 35 into a second end position 36 in said cylindrical recess in the housing 14. The first and second end positions 35, 36 are indicated by dashed lines in FIG. 10. In the second end 36 position the second rib 34 is indexed opposite a corresponding groove 37 in the cylindrical recess. The groove 37 extends a predetermined axial distance into the housing 14 and ends in the second radial surface 32. The second radial surface 32 forms a stop for the end surface 33 of the second rib 34. The lock cylinder 13 may then be pushed into the housing 14 against the force of a return spring means, allowing the lock cylinder 13 to be axially displaced a predetermined distance relative into the housing 14. This distance is determined by the axial extension of the groove 37 in the housing 14. In order to create a distinct indication to the user that the lock cylinder has reached either of the first end position 35 or the second end position 36, the first radial surface 31 is provided with a raised notch or projection 38. When the user rotates the key to switch between the two modes, the projection 38 will displace the end of the second rib 34 and the lock cylinder 13 away from the first radial surface 31 sufficiently to create a slight resistance to the rotation. The user will feel that the lock cylinder has reached the respective end position when the end surface 33 of the second rib 34 passes out of contact with the projection 38. The projection 38 will also maintain the lock cylinder 13 in the desired mode by preventing inadvertent rotation of the lock cylinder.

When the lockable dispenser is in the push-button operated mode, the lock cylinder 13 is arranged axially slidable in the opening 20 in the lock catch 11. In this way, the lock cylinder 13 can be used as a push button for unlocking the dispenser. As described above, a return spring is provided between the housing 14 and the lock cylinder 13. Axial displacement of the lock cylinder 13 from a first position to a second position will compress the coil spring, which will return the lock cylinder 13 to its first position upon release of the lock cylinder 13.

The lock catch 11 is located in said slot 21 in the housing, where it is arranged rotatable in a plane at right angles to the longitudinal axis of the lock cylinder 13. In the push-button mode, the lock catch 11 is arranged to be rotatable under simultaneous axial displacement of the lock cylinder 13. In order to cause a rotation of the lock catch 11, at least one of the lock cylinder 13 and/or the lock catch 11 is provided with at least one oblique surface arranged to cooperate with a corresponding surface on the lock cylinder 13 or the lock catch 11.

According to the example shown in FIGS. 8-10, the lock cylinder 13 is provided with a pair of oblique surfaces 41 (only one shown) arranged to cooperate with corresponding surfaces in radially extending first and second recesses 23, 43 in the opening 20 in the lock catch 11. The second recess 43 comprises a radial cut-out section extending over a predetermined second angle. The recess 43 further comprises opposing first and second end surfaces 44, 45. Each oblique surface 41 is arranged on a radial projection, in the form of a peripheral third rib 46 (only one shown) arranged in the longitudinal direction of the lock cylinder 13. The third ribs 46 are located at opposite sides of the lock cylinder 13, separated by an angle of 180°. In the example shown, the third ribs 46 are arranged between the first and the second ribs 22, 34 in the axial direction of the lock cylinder 13. One of the said third ribs 46 is shown in FIG. 8. The oblique surface 41 on the third rib 46 is a helical surface arranged at an angle of less than 45°, in this case preferably about 30°, relative to the direction of an imaginary generatrix of the lock cylinder 13. The respective oblique surfaces 41 on the lock cylinder 13 are arranged facing a corresponding end surface 24, 44 in their respective first and second recesses 23, 43. In this example, both end surfaces 24, 44, which are arranged for cooperation with the respective ribs 46 are located in the same plane through the longitudinal axis of the lock cylinder 13, at opposite sides thereof. As the respective oblique surface 41 on the third rib 46 is displaced axially during depression of the lock cylinder 13, it comes into contact with its corresponding end surface 24, 44. Further depression of the lock cylinder 13 forces the lock catch 11 to rotate as the oblique surfaces 41 causes a progressive displacement of their respective end surfaces 24, 44 of the second recesses 23, 43.

When the lockable dispenser is switched from the key operated mode to the push-button mode, the rotation of the lock cylinder 13 in the second direction B also causes the first peripheral rib 22 to be displaced in the first recess 23. The first peripheral rib 22 will be displaced from its first position in contact with the first end surface 24 to a second position halfway in between the first surface 24 and its opposing second end surface 25. This location of the first rib 22 in the first recess 23 will allow the lock catch 11 to be rotated and the cover to be shut by simply pressing the cover, as described below.

In order to close the cover, the user simply pushes the cover towards its closed position. As described above, the bevelled front surface 17 on the lock catch 11 will first come into contact with the receiving portion. An additional force applied to the front wall of the cover will cause the bevelled surface 17 to displace the lock catch 11 relative to the receiving portion. Displacement of the lock catch will also cause a relative displacement between the opposing end surfaces 24, 25 of the first recess 23 and the stationary first rib 22 on the lock cylinder 13. Towards the end of the displacement the first rib 22 will be located adjacent the second surface 25, away from the intermediate position between the said opposing end surfaces 24, 25. The lock catch 11 will be rotated against the force of the spring load and allow a front portion of the lock catch to move past the receiving portion so that the locking recess 12 in the lock catch 11 can be hooked over or around a receiving portion. The lock catch 11 will then snap back under the force of the spring load into engagement with the receiving portion to lock the container.

Figure 11:
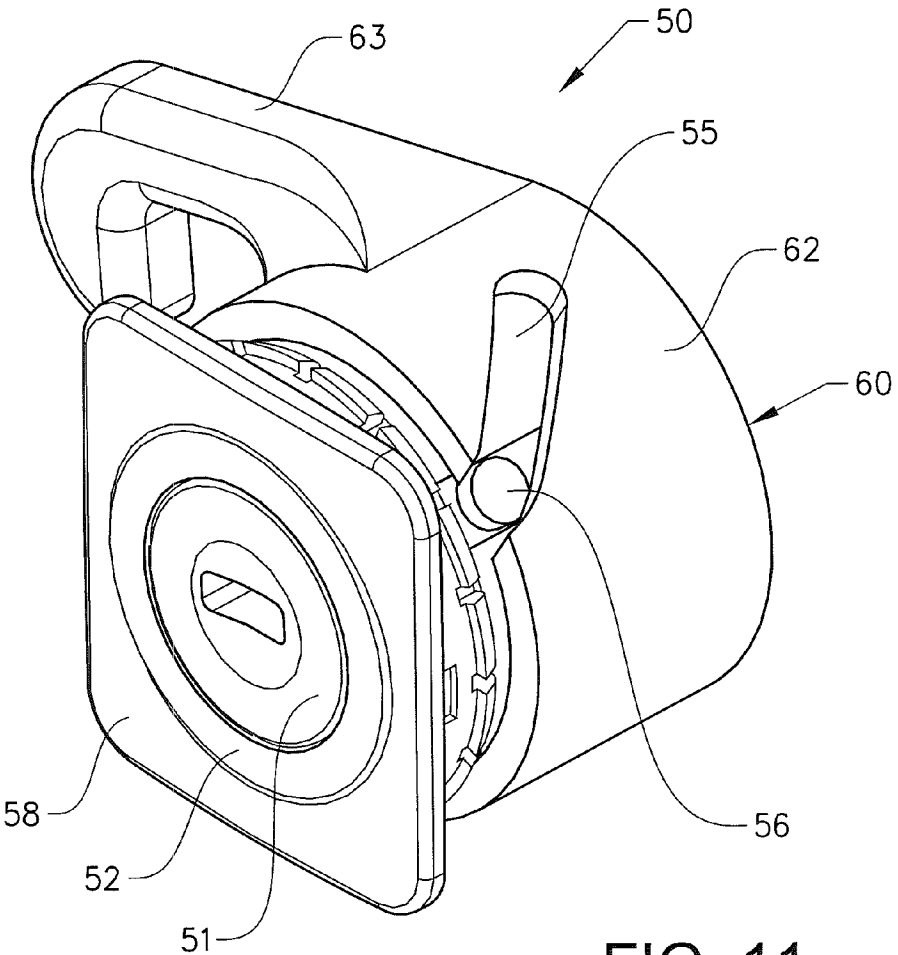
FIG. 11 shows a lock according to a second embodiment of the invention.
Figure 12:
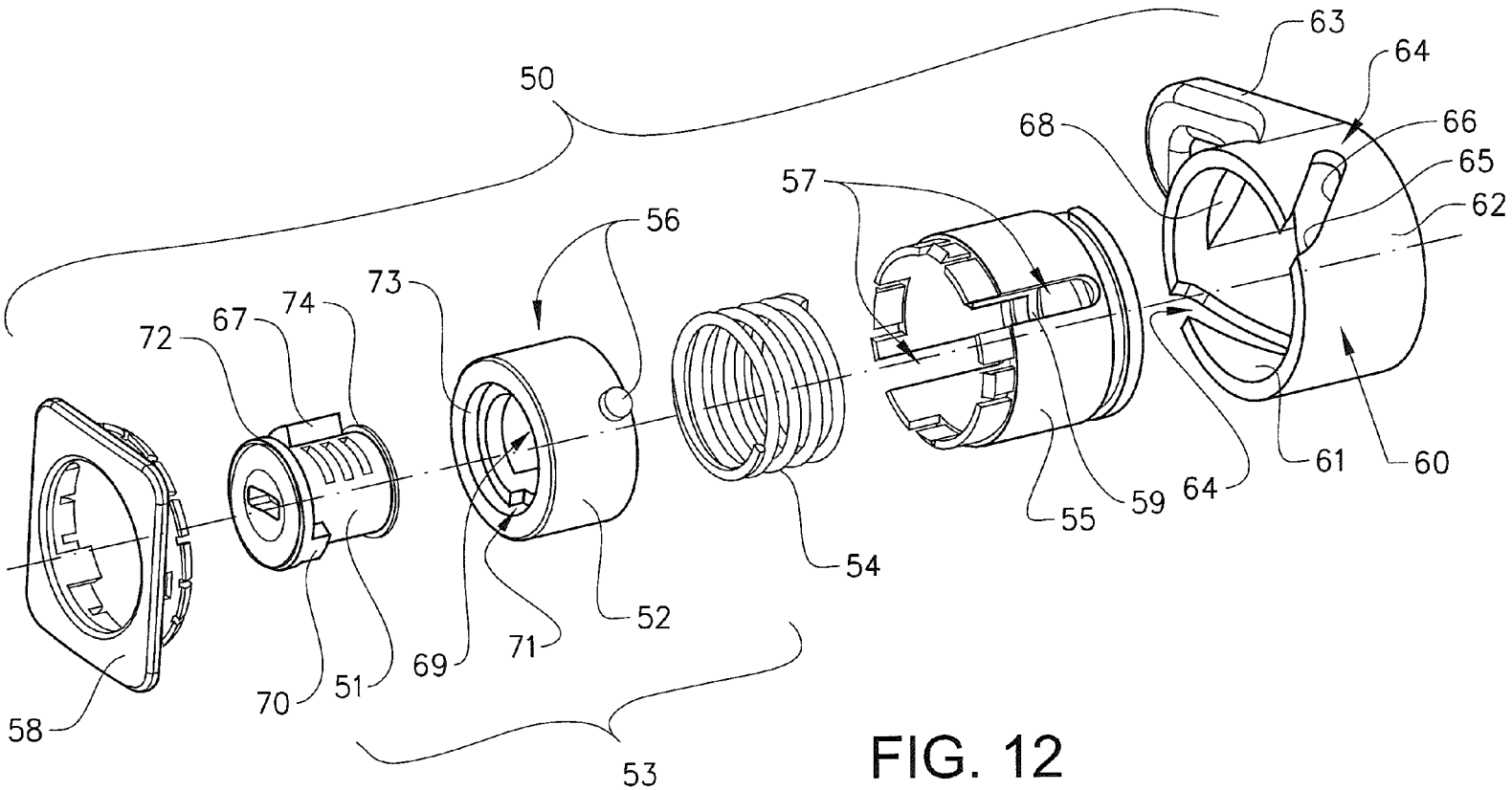
FIG. 12 shows an exploded view of the lock in FIG. 11.

FIG. 11 shows a lock 50 according to an alternative embodiment of the invention. FIG. 12 shows an exploded view of the lock 50 in FIG. 11. In this example, a lock cylinder 51 is mounted in a cylindrical body 52 in which the lock cylinder 51 is substantially fixed against axial displacement but selectively rotatable by means of a key (not shown). The assembled lock cylinder 51 and cylindrical body 52 forms an actuating means 53 acting as a push-button that is mounted axially displaceable against a coil spring 54 in a first housing 55. The lock cylinder 51 is selectively rotated relative the cylindrical body 52 to assume a key operated mode and a push-button operated mode. The cylindrical body 52 is provided with a pair of diametrically opposite projections 56 on its outer cylindrical surface, which projections 56 cooperate with corresponding axial slots 57 through the outer cylindrical wall of the first housing 55. The first housing 55 is snapped onto and attached to a second housing 58 using cooperating resilient means to form an assembled housing for the lock cylinder 51, cylindrical body 52 and the coil spring 54. The coil spring 54 is mounted in a groove at the inner end of the cylindrical body 52 and acts against an annular end surface 59 at the inner end of the first housing 55. The second housing 58 forms an outer portion of the lock 50 that can be mounted so as to be fixed and non-rotatable in an opening in a container (not shown). In its mounted position, the second housing 58 and the actuating means 53 are accessible to a user. The first housing 55 and its inner portion is arranged to cooperate with a lock catch 60. The inner portion of the first housing 55 passes through a corresponding opening 61 in the lock catch 60. The lock catch 60 comprises a cylindrical portion 62 and hook shaped latch 63. The lock catch 60 is arranged rotatable about the central axis of the lock cylinder 51, in a plane at right angles to said axis, but is fixed against axial displacement relative to the first housing 55. The cylindrical portion 62 of the lock catch 60 is provided with a pair of angled slots 64 through its outer wall. An initial portion 65 of each slot 64, facing the outer second housing 58, is arranged at a first angle relative to a generatrix on the cylindrical portion 62 of the lock catch 60. The inner, main portion 66 of the slot 64 is arranged at a second angle relative to said generatrix. in this example, the initial portion 65 of the slot is arranged at an angle in the range of 20°, while the remaining portion 66 is arranged at an angle of 45°. The length of the initial portion 65 of the slot 64 is marginally larger than the size of the projection 56 on the cylindrical body 52. The width of the slot 64 is sufficient to allow sliding cooperation with the corresponding projection 56.

In the key operated mode the lock cylinder 51 has been rotated relative to the cylindrical body 52 so that a first cam 67 on the outer surface of the lock cylinder 51 is indexed relative to a radially extending surface 68 in the inner opening of the cylindrical portion 62 of the lock catch 60. The first cam 67 is also placed in contact with a cooperating internal cam (not shown) extending from the inner surface of the cylindrical body 52. In this position, an end surface of the first cam 67 on the lock cylinder 51 is arranged in contact with the radially extending surface 68 in the cylindrical portion 61 of the lock catch 60. This prevents axial displacement of the actuating means 53 and the container is locked. When a key is inserted into the lock cylinder 51, clockwise rotation of the key causes a side surface of the first cam 67 into contact with the internal cam. The actuating means 53 is thereby rotated so that the projections 56 are displaced into cooperating contact with the initial portion 65 of the respective slots 64. Further rotation of the key applies a force on the projections 56 which force is transmitted to the initial portion 65 of the slot 64 and causes rotation of the lock catch 60 out of contact with the receiving portion.

The lock 50 can be set in the push button operated mode by rotating the key and the lock cylinder 51 in the opposite, anti-clockwise direction compared to that used for key operation of the lock. Anti-clockwise rotation of the key causes a second cam 70 on the outer surface of the lock cylinder 51 to be displaced from a first position to a second position in a radial recess 71 in the inner surface of the cylindrical body 52. The radial recess 71 has opposing end surfaces to determine end positions for the respective first and second positions. The second cam 70 has an end surface facing a substantially flat radial surface of the recess 71. The radial surface of the recess 71 is provided with a raised projection (not shown) located half way between the first and the second position to determine the end positions representing the key and the push button operated modes, respectively. When the user rotates the key to switch between the two modes, the projection will displace the end surface of the second cam 70 and the lock cylinder 51 away from the radial surface of the recess 71 sufficiently to create a slight resistance to the rotation. The user will feel that the lock cylinder 51 has reached the respective end position when the end surface of the second cam 70 passes out of contact with the projection. The projection will also maintain the lock cylinder 51 in the desired mode by preventing inadvertent rotation of the lock cylinder. The second cam 70 is located behind a radially extending collar 72 located in a corresponding annular recess 73 in the inner surface at the front of the cylindrical body 52. This allows the front surface of the lock cylinder 51 to be mounted flush with the front surface of the cylindrical body 52 in the outer second housing 58. The lock cylinder is held in place in the cylindrical body 52 by a lock ring 74 located in a groove at the inner end of the lock cylinder.

When in the push-button operated mode, the second cam 70 has been rotated away from the radially extending surface 68 in the cylindrical portion 61 of the lock catch 60. In this position the second cam 70 can be displaced axially past the radially extending surface 68. In the push-button operated mode the projections 56 cooperate with the axial slots 57 through the outer cylindrical wall of the first housing 55 and with the main portion 66 of each slot 64 in the lock catch 60.

Axial displacement of the actuating means 53 in the axial slots 57 of the first housing 55 forces the projections 56 into contact with their respective angled main slot 66 and causes the cylindrical portion 62 of the lock catch 60 to rotate. In this way the lock catch 60 may be rotated out of contact with the receiving means when the lock cylinder 51 and the cylindrical body 52 are pushed into the first housing 55 by a user. The length of the main portion 66 is dependent on the angle of the slot 64 and the required angle through which the lock catch must be rotated to release the receiving portion.

Figure 13:
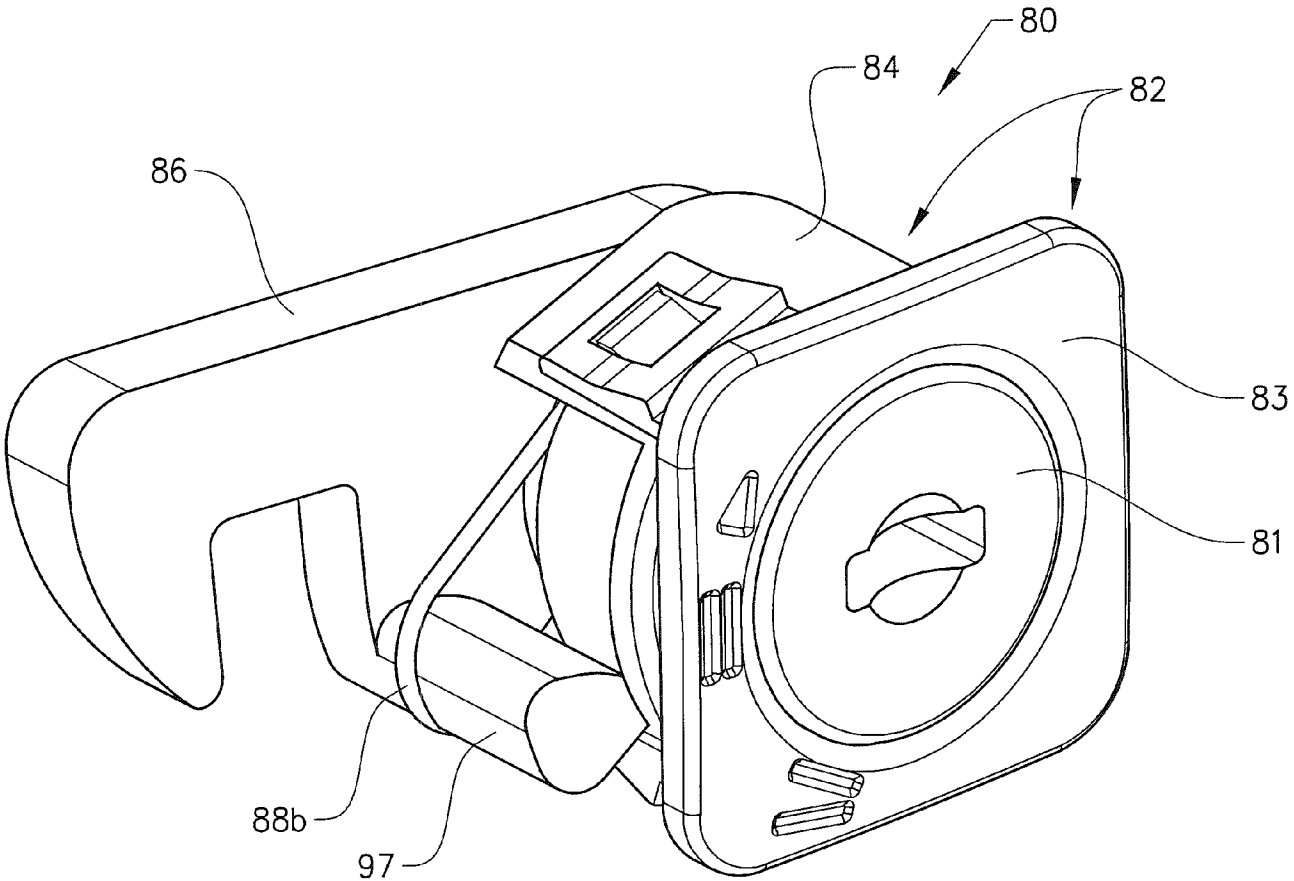
FIG. 13 shows a lock according to a third embodiment of the invention.
Figure 14:
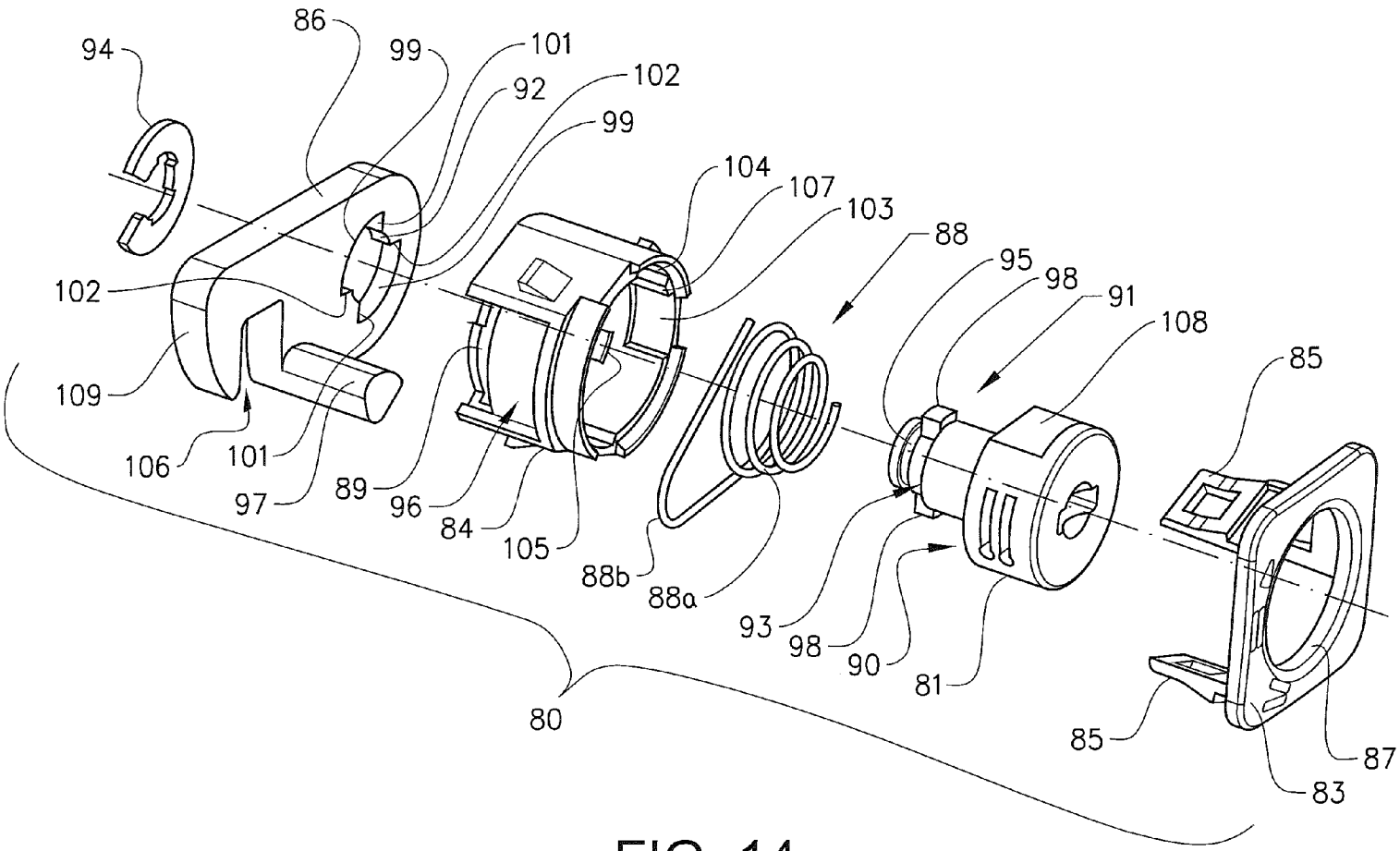
FIG. 14 shows an exploded view of the lock in FIG. 13.

FIG. 13 shows a lock 80 according to an alternative embodiment of the invention. FIG. 14 shows an exploded view of the lock 80 in FIG. 13. In this example, a lock cylinder 81 is mounted axially displaceable in a housing 82. The housing 82 comprises an outer portion 83 that may be attached so as to be fixed and non-rotatable in an opening in the container (not shown), where it is accessible to a user. The housing 82 further comprises an inner portion 84 attached to the outer portion 83 by snap-on means 85 and is arranged in contact with a lock catch 86. The lock cylinder 81 is mounted axially displaceable inside the inner portion 84 of the housing 82 and passes through a corresponding opening 87 in the outer portion 83 of the housing 82. In an initial position the front surface of the lock cylinder 81 is arranged substantially flush with the front surface of the outer portion 83 of the housing 82. A spring means 88 is located between an inner annular end surface 89 of the inner portion 84 of the housing 82 and a facing annular surface 90 on the lock cylinder 81. The spring means 88 comprises a conical coil spring 88*a* arranged to maintain the lock cylinder 81 in its initial position relative to the front surface of the outer portion 83 of the housing 82. An inner end 91 of the lock cylinder 81 is inserted through the inner portion 84 of the housing 82 and into an opening 92 in the lock catch 86 at the inner end of said housing 82. The lock catch 86 is attached between an annular surface 93 adjacent the said inner end 91 of the lock cylinder 81 and a locking washer 94 located in a groove 95 at the inner end 91 of the lock cylinder 81. In this way the lock cylinder 81 is both rotatable and fixed against axial displacement relative to the lock catch 86. When the lock cylinder 81 is in its initial position, the lock catch 86 is in contact with the inner end of the inner portion 84 of the housing 82. The spring means 88 further comprises a return spring 88*b* provided to maintain the lock catch 86 in a predetermined, spring loaded position relative to the inner portion 84 of the housing 82. The return spring 88*b* is shaped as a V- or U-shaped extending radially outwards from the main body of the spring means. The return spring 88*b* is made from one end of the coil spring 88*a* to form a combined spring means 88. The radially extending return spring 88*b* projects out of an opening 96 in the inner portion 84 of the housing 82, which opening 96 prevents the return spring 88*b* from rotating relative to the housing 82. The V- or U-shaped section of the return spring 88*b* is placed or hooked around an axial projection 97 on the lock catch 86. The axial projection 97 is arranged parallel to the axis of the lock cylinder 81 and extends from the lock catch 86 past the opening 96 in the inner portion 84 in the housing 82. The extent of the opening 96 in the peripheral direction of the inner portion 84 of the housing 82 can be used to limit the angle over which the lock catch 86 can be rotated. Rotation of the assembled lock cylinder 81 by means of a key to release the lock catch 86 will cause the projection 97 to be pivoted about the axis of the lock cylinder 81 and pre-load the return spring 88*b*.

Alternatively, the lock cylinder 81 and the lock catch 86 may be spring loaded by separate spring means.

The inner section 91 of the lock cylinder 81 passing through the lock catch 86 is provided with a pair of radially extending projections 98 arranged to cooperate with corresponding recesses 99 in the opening 92 through the lock catch 86. The projections 98 can be rotated between opposing end surfaces 101, 102 in the recesses 99, which end surfaces define a first and a second position as the lock cylinder 81 is selectively rotated by a key during mode selection.

In the key operated mode the lock cylinder 81 may be rotated clockwise relative to the lock catch 86 so that the radial projections 98 on the outer surface of the inner portion 91 of the lock cylinder 81 is moved into contact with a first end surface 101 in the recess in the lock catch 86. To achieve this position, the key inserted into the lock has displaced a number of plate tumblers (not shown) extending transversely through the lock cylinder 81. The plate tumblers will, in their locked position, extend a short distance out of the outer surface of the lock cylinder 81 and into one of a pair of recesses 103, 104 in the inner wall of the inner portion 84 of the housing 82. When the key is inserted, the plate tumblers will move out of contact with said recesses 103, 104 and allow rotation of the lock cylinder relative to the housing 82. When set in the key operated mode, the lock tumblers are indexed with a first recess 103 and the inner portion 91 of the lock cylinder 81 are in contact with the first end surface 101 in the recess in the lock catch 86. In this position, the annular surface 90 on the lock cylinder 81 is in contact with a number of ribs 105 (one shown) extending from the inner surface of the inner portion 84 of the housing 82, in order to prevent the lock cylinder 81 from being axially displaced by application of a pushing force by a user.

Rotation of the key will cause the radial projections 98 on the lock cylinder 81 to be forced against the first end surfaces 101 in the respective recess 99 and rotate the lock catch 86. When rotated against the spring load a locking recess 106 in the lock catch 86 will be moved out of contact with a receiving means and release the cover of the container. The lock catch 86 will be returned to its initial position by the return spring 88*b* when the key is released.

The lock may be set in the push button operated mode by rotating the key and the lock cylinder 81 in the opposite direction to that used for key operation. By inserting the key the lock tumblers are released from the first recess 103 in the inner portion 84 of the housing 82, allowing the lock cylinder to be rotated anti-clockwise, past an axial rib 107 separating the first and second recesses, and into the second recess 104. At the same time, the radial projections 98 on the outer surface of the lock cylinder 81 are moved into contact with an opposite second end surface 102 in the recesses 99 in the lock catch 86. In this position, a cut-out 108 in the outer cylindrical surface of the lock cylinder 81 has been indexed with a corresponding rib 105 on the inner surface of the inner portion 84 of the housing 82. In this position the cut-out is arranged to allow the lock cylinder 81 to be axially displaced a predetermined distance in the inner portion 84 of the housing 82. This distance is determined by the axial extent of the cut-out 108. The lock cylinder 81 may then be displaced into the inner portion 84 of the housing 82 against the force of the coil spring 88*a*. As the lock cylinder 81 and the lock catch 86 are fixed to each other, axial displacement of the lock cylinder 81 will also cause an axial displacement of the lock catch 86 and move the locking recess 106 out of contact with the receiving means In order to close the cover, the user simply pushes the cover towards its closed position. A bevelled front surface 109 on the lock catch 86 will first come into contact with the receiving portion. An additional force applied to the front wall of the cover will cause the bevelled surface 109 to displace the lock catch 86 relative to the receiving portion. The lock catch 86 will be rotated against the force of the spring load and allow a front portion of the lock catch to move past the receiving portion so that the locking recess 106 in the lock catch 86 can be hooked over or around a receiving portion. The lock catch 86 will then snap back under the force of the return spring 88*b* into engagement with the receiving portion to lock the container.

The invention is not limited to the above examples, but may be varied freely within the scope of the appended claims. For instance, in the above examples the lock is located in the cover and the receiving portion is located on the base part. Within the scope of the invention, the opposite arrangement may also be used.

The invention claimed is:

1. A lockable container arrangement, comprising:

an interior;

an exterior;

a base part;

a cover pivotally attached to the base part for displacement between a closed position in which the cover and the base part delimit a substantially enclosed space and an open position; and a lock mounted on said container arrangement, said lock comprising a lock catch operable from the exterior of the container arrangement, said lock catch structured and arranged to engage a receiving portion to lock the container arrangement, wherein the container arrangement can be selectively set in a key operated mode where the lock catch is operable by a key in a lock cylinder so that turning of the key separates the lock catch from the receiving portion, or in a push button operated mode where the lock catch rotates about an axis parallel to a direction of a pressing force applied onto the lock cylinder.

2. The lockable container arrangement according to claim 1, wherein the key is rotatable in a first direction, which rotation sets the container arrangement in the key operated mode.

3. The lockable container arrangement according to claim 2, wherein the lock catch is operable by the rotation of the key in the first direction.

4. The lockable container arrangement according to claim 1, wherein the key is rotatable in a second direction, which rotation sets the container arrangement in the push button operated mode.

5. The lockable container arrangement according to claim 1, wherein the lock comprises the lock cylinder arranged in contact with and cooperating with the lock catch.

6. A lockable container arrangement, comprising:

an interior;

an exterior;

a base part;

a cover pivotally attached to the base part for displacement between a closed position in which the cover and the base part delimit a substantially enclosed space and an open position; and a lock mounted on said container arrangement, said lock comprising a lock catch operable from the exterior of the container arrangement, said lock catch structured and arranged to engage a receiving portion to lock the container arrangement, wherein the container arrangement can be selectively set in a key operated mode where the lock catch is operable by a key in a lock cylinder, or in a push button operated mode where the lock catch is operable by application of a pressing force onto the lock cylinder, the lock comprises the lock cylinder arranged in contact with and cooperating with the lock catch, and the lock catch is arranged rotatable in a plane at right angles to the axis of the lock cylinder.

7. The lockable container arrangement according to claim 6, wherein the lock catch is arranged to be spring loaded into engagement with the receiving portion to lock the container arrangement.

8. The lockable container arrangement according to claim 5, wherein the lock cylinder is arranged axially slidable in an aperture in the lock catch, when in the push-button operated mode.

9. The lockable container arrangement according to claim 8, wherein the lock catch is arranged to be rotatable under simultaneous axial displacement of the lock cylinder.

10. The lockable container arrangement according to claim 9, wherein at least one of the lock cylinder and the lock catch is provided with an oblique surface arranged to cooperate with a corresponding surface on the other of the lock catch or the lock cylinder.

11. The lockable container arrangement according to claim 10, wherein the lock cylinder is provided with an oblique surface arranged to cooperate with a corresponding surface in a radially extending recess in the lock catch.

12. The lockable container arrangement according to claim 10, wherein the lock cylinder is provided with a radially extending projection arranged to cooperate with an oblique surface in a recess in the lock catch.

13. The lockable container arrangement according to claim 5, wherein the lock cylinder is arranged rotatable with the lock catch, when in the key operated mode.

14. The lockable container arrangement according to claim 13, wherein the lock cylinder and the lock catch are provided with cooperating surfaces each located in a radial plane relative to the axis of the lock cylinder, which radial surfaces are arranged to prevent axial displacement of the lock cylinder.

15. A lockable container arrangement, comprising:

an interior;

an exterior;

a base part;

a cover pivotally attached to the base part for displacement between a closed position in which the cover and the base part delimit a substantially enclosed space and an open position; and a lock mounted on said container arrangement, said lock comprising a lock catch operable from the exterior of the container arrangement, said lock catch structured and arranged to engage a receiving portion to lock the container arrangement, wherein the container arrangement can be selectively set in a key operated mode where the lock catch is operable by a key so that turning of the key separates the lock catch from the receiving portion, or in a push button operated mode where the lock catch rotates about an axis parallel to a direction of a pressing force applied onto the lock by a user.

16. The lockable container arrangement according to claim 15, wherein the key is rotatable in a first direction, which rotation sets the container arrangement in the key operated mode.

17. The lockable container arrangement according to claim 16, wherein the lock catch is operable by the rotation of the key in the first direction.

18. The lockable container arrangement according to claim 15, wherein the key is rotatable in a second direction, which rotation sets the container arrangement in the push button operated mode.

19. The lockable container arrangement according to claim 15, wherein the lock comprises a lock cylinder arranged in contact with and cooperating with the lock catch.

* * * * *